US010329086B1

(12) United States Patent
Toson et al.

(10) Patent No.: US 10,329,086 B1
(45) Date of Patent: Jun. 25, 2019

(54) TRASH RECEPTACLE FOR RECYCLABLE PRODUCTS AND ASSOCIATED USE THEREOF

(71) Applicants: Cordell Toson, Clarksburg, NJ (US); Frank Toson, Sicklerville, NJ (US)

(72) Inventors: Cordell Toson, Clarksburg, NJ (US); Frank Toson, Sicklerville, NJ (US)

( * ) Notice: Subject to any disclaimer, the term of this patent is extended or adjusted under 35 U.S.C. 154(b) by 0 days.

(21) Appl. No.: 15/673,315

(22) Filed: Aug. 9, 2017

Related U.S. Application Data

(60) Provisional application No. 62/372,385, filed on Aug. 9, 2016.

(51) Int. Cl.
*B65F 1/14* (2006.01)
*B65F 1/16* (2006.01)
*B65D 25/16* (2006.01)

(52) U.S. Cl.
CPC ..... *B65F 1/1463* (2013.01); *B65D 25/16* (2013.01); *B65F 1/141* (2013.01); *B65F 1/1405* (2013.01); *B65F 1/16* (2013.01); *B65F 2230/15* (2013.01); *B65F 2250/112* (2013.01)

(58) Field of Classification Search
CPC ..... B65F 1/06; B65F 1/1463; B65F 1/14; B65F 1/1405; B65F 1/141; B65F 1/163; B65F 1/1623; B65F 1/16; B65D 25/16; B65D 25/22; B65D 43/262; B65D 43/26; B65D 43/16
USPC ..... 220/495.11, 495.08, 495.06, 908.1, 908, 220/481, 480, 476, 263, 262, 264, 810, 220/634, 630, 628
See application file for complete search history.

(56) References Cited

U.S. PATENT DOCUMENTS 1,911,724 A * 5/1933 Stein ..... B65F 1/06 220/495.11
3,055,568 A * 9/1962 Zalkind ..... B65D 5/56 220/495.11
3,487,989 A * 1/1970 Ignell ..... B65D 15/02 156/227
3,997,072 A * 12/1976 Guth ..... B65F 1/06 100/229 A
5,213,294 A * 5/1993 DeBord ..... B65F 1/141 16/374

(Continued)

FOREIGN PATENT DOCUMENTS

JP 05310303 A * 11/1993 ..... B65F 1/1463
JP H0715601 U * 3/1995 ..... B65F 1/14

OTHER PUBLICATIONS

Translation of JPH0715601, Mar. 17, 1995, Figs. 2 and 3, Paragraph 8.*

(Continued)

*Primary Examiner* — Robert J Hicks
(74) *Attorney, Agent, or Firm* — Ashkan Najafi

(57) ABSTRACT

A trash receptacle includes a support base, and a portable storage container having a centrally registered longitudinal axis, wherein the portable storage container is detachably seated on the support base such that the support base is located exterior of the portable storage container. A trash bag is removably lined within the storage container and situated about the centrally registered longitudinal axis. Advantageously, the trash bag is suitably configured inside the portable storage container to receive and hold existing drink cups in a vertically stacked pattern.

11 Claims, 7 Drawing Sheets

(56) References Cited

U.S. PATENT DOCUMENTS

| | | | | |
|---|---|---|---|---|
| 6,253,949 | B1 * | 7/2001 | Dickson | B65F 1/06 220/495.04 |
| 2010/0176126 | A1 * | 7/2010 | Shikano | B65F 1/06 220/23.91 |

OTHER PUBLICATIONS

Translation of JP05310303, Takagi et al., Nov. 22, 1993, Figs. 3 and 4, Paragraph 12.*

* cited by examiner

TRASH RECEPTACLE FOR RECYCLABLE PRODUCTS AND ASSOCIATED USE THEREOF

CROSS REFERENCE TO RELATED APPLICATIONS

This is a non-provisional patent application that claims the benefit of U.S. provisional patent application No. 62/372,385 filed Aug. 9, 2016, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to trash receptacles and, more particularly, to a trash receptacle for recyclable products including a bag-lined recycling receptacle configured for disposing of plastic drinking cups in a vertical, nesting or stacked manner and thereby providing environmentally-conscious consumers with a streamlined, space-saving, everyday use receptacle that facilitates easy recycling of commonly used plastic cups. The trash receptacle is a free-standing unit that can also be easily mounted to a wall.

Prior Art

While it may seem to be a relatively recent concept, recycling has actually been around for thousands of years. As ancient cultures learned to make metal products, they realized they could melt down broken and overused swords and pots to construct new ones. Recycling as it is known today gained popularity in the 1970s as people became aware of its importance to the environment. In addition to recovering valuable raw materials, recycling is the most effective way to keep waste out of landfills. With fewer landfills, there is more space for people to farm, work, and live. Perhaps most importantly, recycling saves energy and greatly reduces pollution, slowing down global climate changes caused by burning fossil fuels like oil and gas. In fact, many states in the U.S. have enacted laws to ensure that materials are properly recycled. Whether following the letter of the law or acting out of a natural concern for the health of their environment, many people strive to properly recycle such household materials such as plastic and glass bottles, newspapers, and magazines.

Particularly, the ubiquitous plastic drinking cup is one of the most environmentally beneficial items available for mass consumption. Before they are taken to a recycling center, however, these cups can result in a couple of drawbacks. A family that consumes a large amount of beverages can soon find a veritable mountain of empties clogging up their wastebaskets. In fact, on average, empty cups typically take up about fifty percent of space in a standard kitchen garbage can, necessitating additional cans as well as liners, both of which cost money and space. Even when the cups are properly placed in a recycling bin, such a receptacle can be quickly filled to bursting with containers, requiring a trip to the recycling center sooner than expected.

Accordingly, a need remains for trash receptacle for recyclable products in order to overcome at least one aforementioned shortcoming. The exemplary embodiment(s) satisfy such a need by providing a trash receptacle for recyclable products including a bag-lined recycling receptacle configured for disposing of plastic drinking cups in a vertical, nesting or stacked manner that is convenient and easy to use, lightweight yet durable in design, versatile in its applications, and designed for providing environmentally-conscious consumers with a streamlined, space-saving, everyday use receptacle that facilitates easy recycling of commonly used plastic cups. The trash receptacle is a free-standing unit that can also be easily mounted to a wall.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a trash receptacle for collecting and disposing drink cups. These and other objects, features, and advantages of the non-limiting exemplary embodiment(s) are provided by a trash receptacle including a support base, and a portable storage container having a centrally registered longitudinal axis, wherein the portable storage container is detachably seated on the support base such that the support base is located exterior of the portable storage container. A trash bag is removably lined within the storage container and situated about the centrally registered longitudinal axis. Advantageously, the trash bag is suitably configured inside the portable storage container to receive and hold existing drink cups in a vertically stacked pattern.

In a non-limiting exemplary embodiment, the support base includes a bottom plate situated along a horizontal axis and having a planar top surface. An annular neck is centrally positioned on top of the planar top surface such that the annular neck extends upwardly therefrom. Notably, the annular neck has a circumferential outer edge detachably engaged about a bottom portion of the portable storage container.

In a non-limiting exemplary embodiment, the support base further includes a wall plate situated along a vertical axis that is parallel to the centrally registered longitudinal axis. In this manner, the wall plate is fixedly coupled to the bottom portion and configured to be affixed to an existing vertical support surface.

In a non-limiting exemplary embodiment, the portable storage container includes a cylindrical tube extending along a major longitudinal length of the centrally registered longitudinal axis. Such a cylindrical tube has an open proximal end and an open distal end axially opposed therefrom. Advantageously, the bottom portion has a stepped-in shoulder located at the open distal end and extended along an entire circumference thereof, wherein the stepped-in shoulder is integrally formed with the cylindrical tube.

In a non-limiting exemplary embodiment, the portable storage container further includes a hollow top lip directly mated to the open proximal end and detachably seated exterior of the cylindrical tube. Such a hollow top lip is axially opposed from the stepped-in shoulder and spaced about the centrally registered longitudinal axis. A lid is pivotally coupled to an outer peripheral edge of the hollow top lip. Such a lid is selectively articulated between an open position and a closed position relative to the open proximal end.

In a non-limiting exemplary embodiment, the portable storage container further includes a smooth and continuous interior surface extended along a major longitudinal length of the cylindrical tube.

In a non-limiting exemplary embodiment, the trash bag includes a closed bottom end removably situated inside the cylindrical tube, and an open top end penetrated upwardly through the hollow top lip and situated exterior of the open proximal end. The trash bag is configured to directly abut against the smooth and continuous interior surface of the cylindrical tube such that the existing drink cups are permitted to travel along the centrally registered longitudinal axis and thereby rest in the vertically stacked pattern.

The present disclosure further includes a method of utilizing a trash receptacle for collecting and disposing drink cups. Such a method including the steps of: providing a support base; providing a portable storage container having a centrally registered longitudinal axis; detachably seating the portable storage container on the support base such that the support base is located exterior of the portable storage container; providing and removably lining a trash bag within the storage container and about the centrally registered longitudinal axis; and configuring the trash bag inside the portable storage container to receive and hold existing drink cups in a vertically stacked pattern.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

FIG. 1 is a perspective view of a trash receptacle, affixed to a vertical support surface, for collecting and disposing recyclable products, in accordance with a non-limiting exemplary embodiment;

FIG. 1*a* is an enlarged view of section 1*a* taken in FIG. 1;

Figure 1:
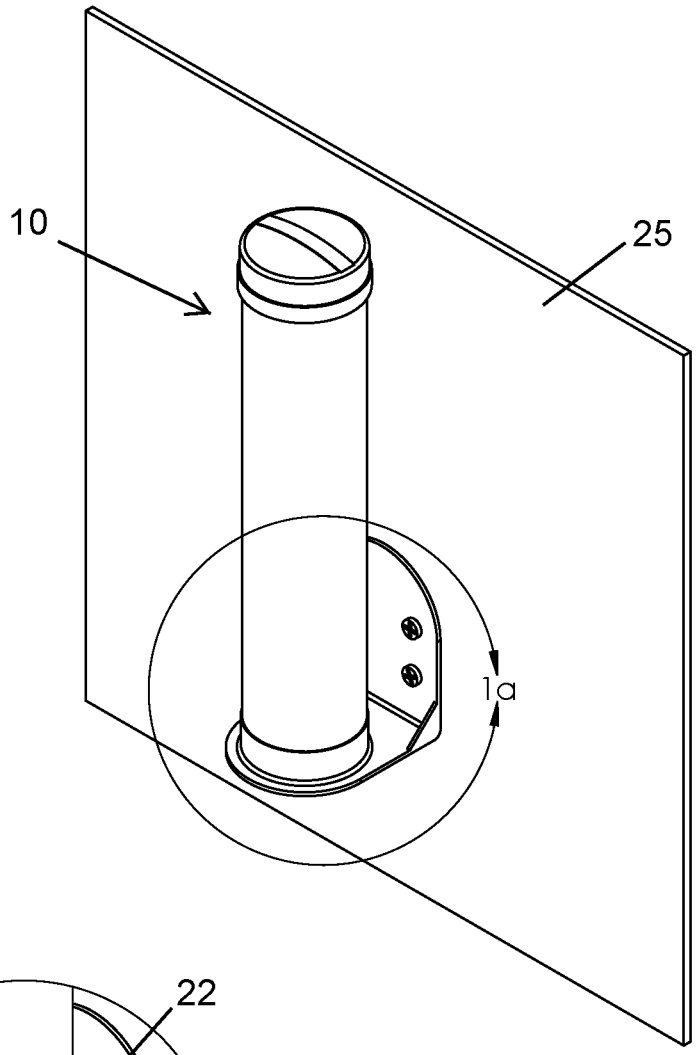
Figure 1A:
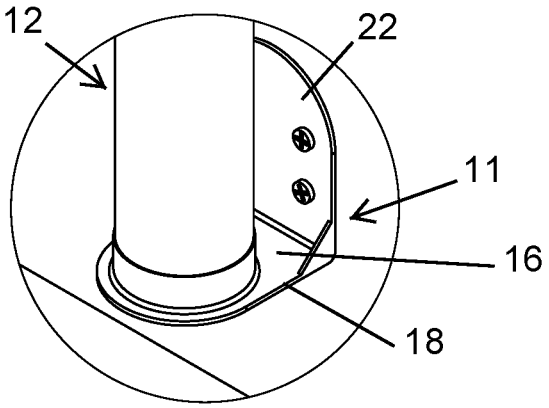

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means±15% of the numerical.

If used herein, "substantially" means largely if not wholly that which is specified but so close that the difference is insignificant.

Figure 2:
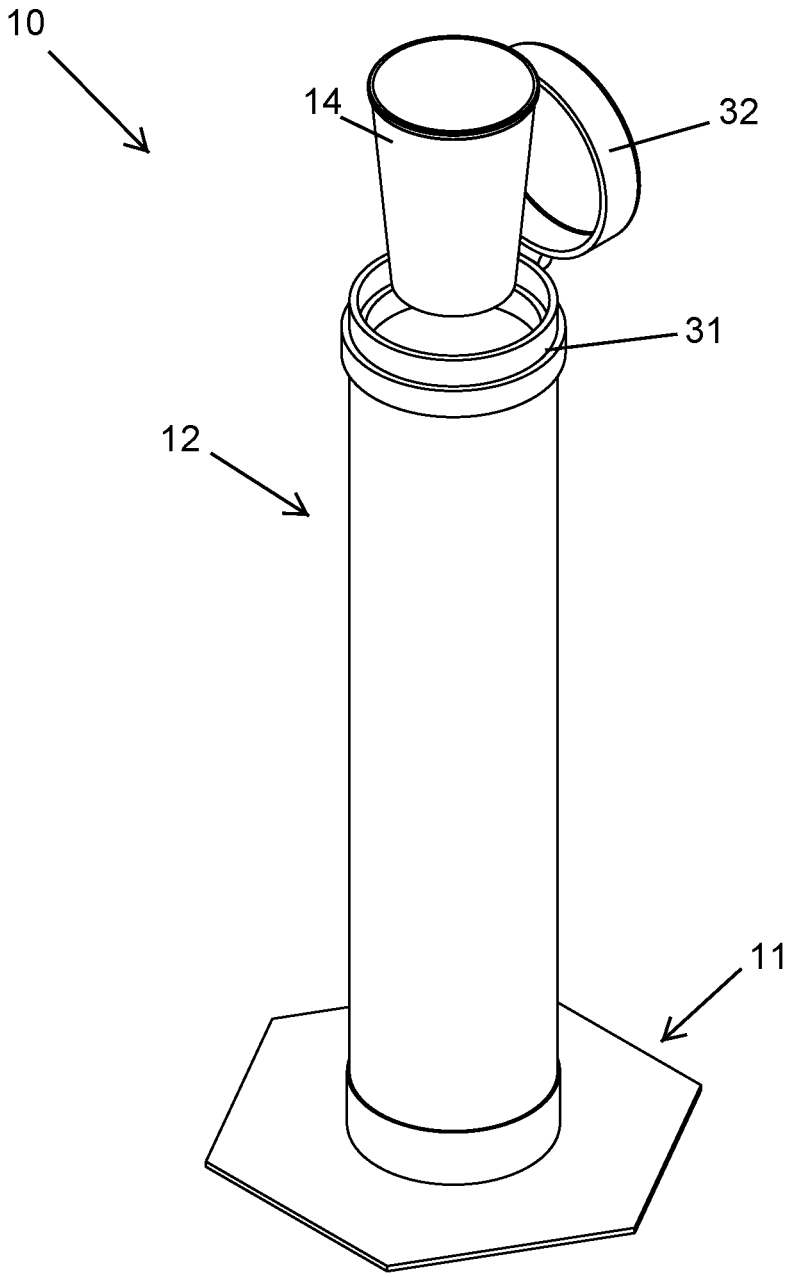
FIG. 2 is a perspective view of a trash receptacle, affixed to a horizontal support base, for collecting and disposing recyclable products, in accordance with another non-limiting exemplary embodiment.
Figure 3:
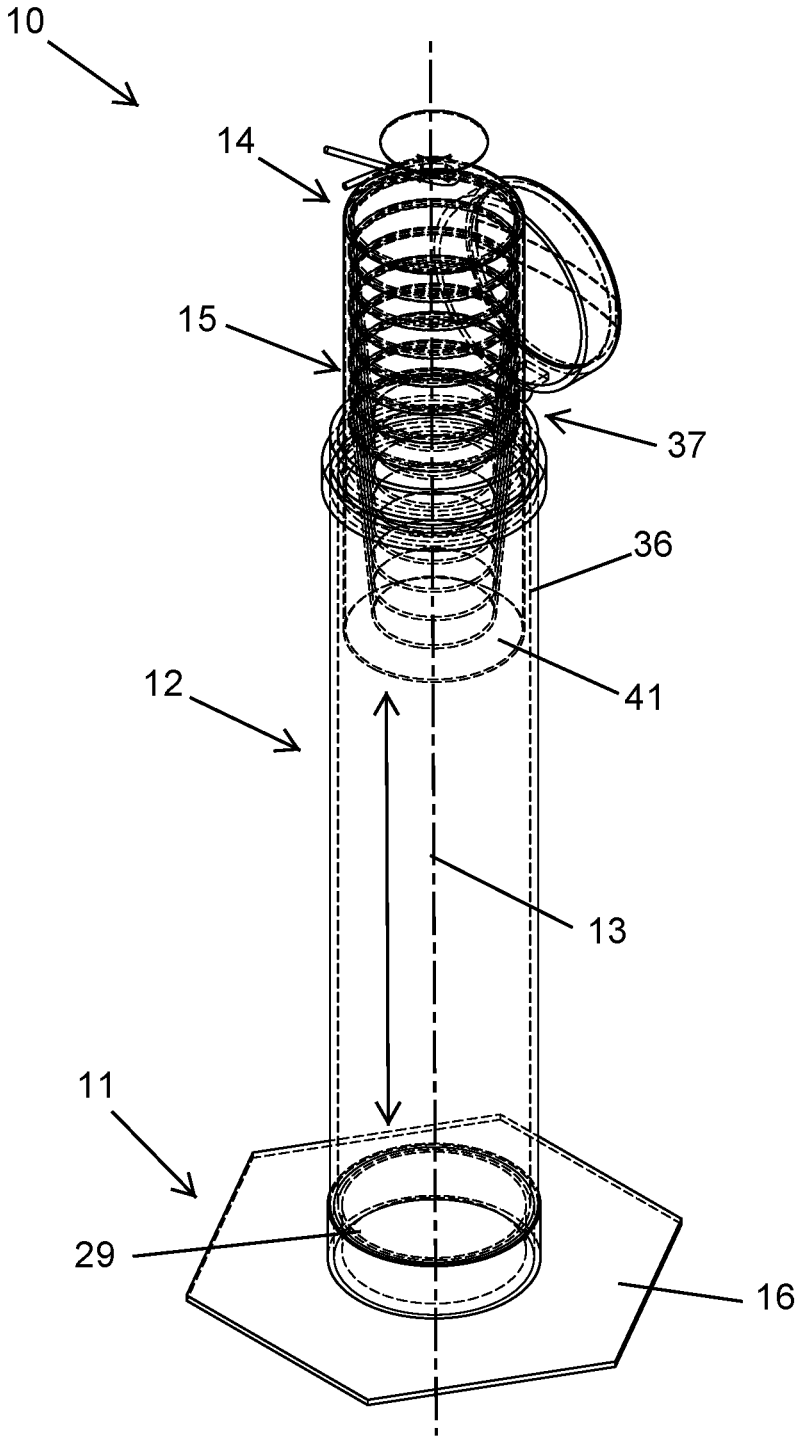
FIG. 3 is a transparent perspective view of the trash receptacle shown in FIG. 2 wherein multiple drinking cups are collected in a vertically stacked pattern within a trash bag.
Figure 4:
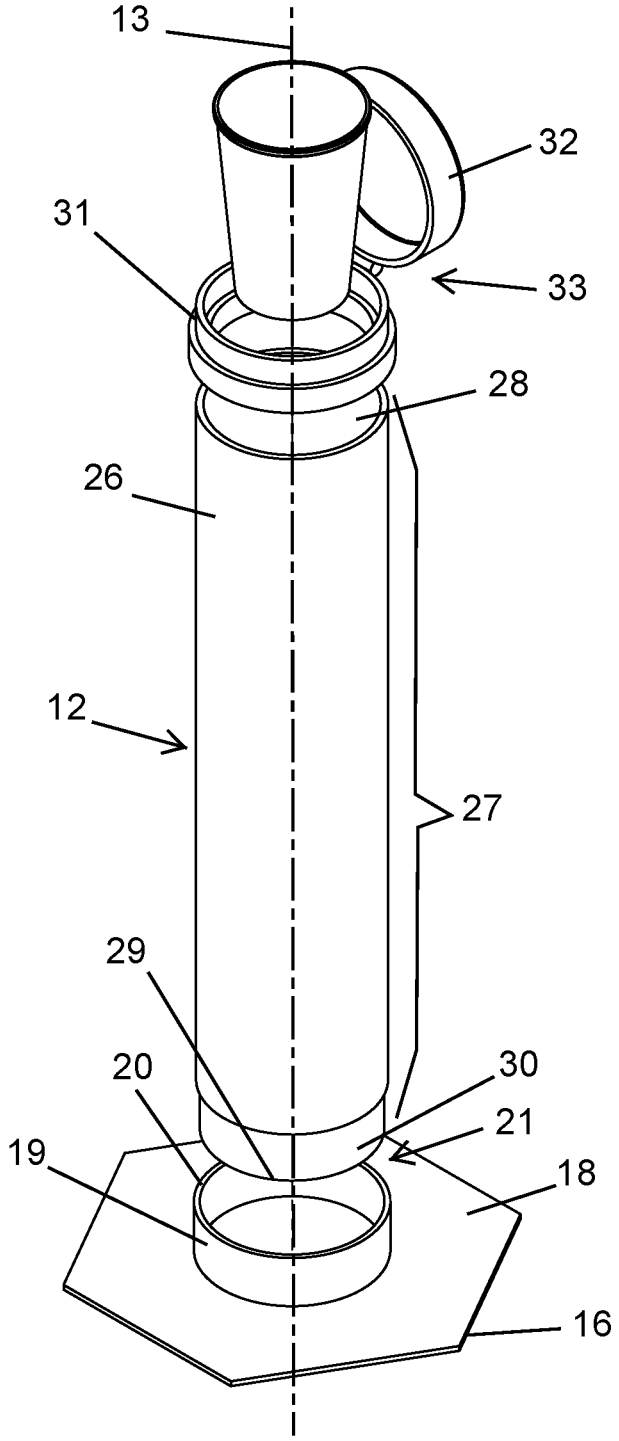
FIG. 4 is an exploded view of the trash receptacle shown in FIG. 2.
Figure 5:
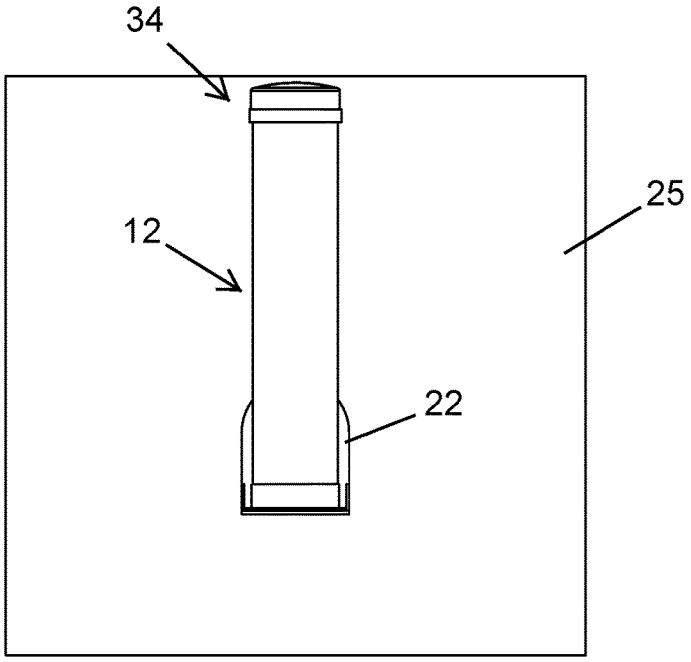
FIG. 5 is a reduced front elevational view of the trash receptacle shown in FIG. 1.
Figure 6:
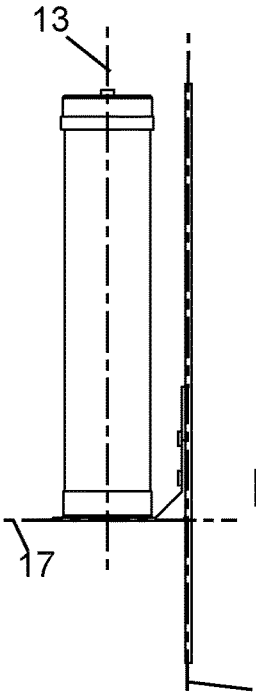
FIG. 6 is a side elevational view of the trash receptacle shown in FIG. 5.
Figure 7:
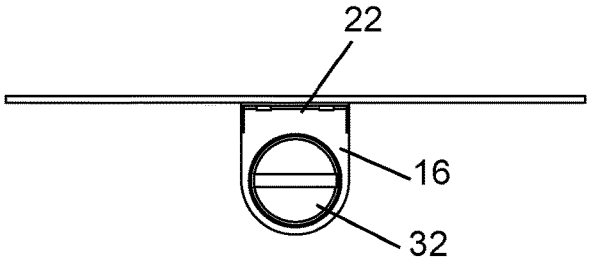
FIG. 7 is a top plan view of the trash receptacle shown in FIG. 5.
Figure 9:
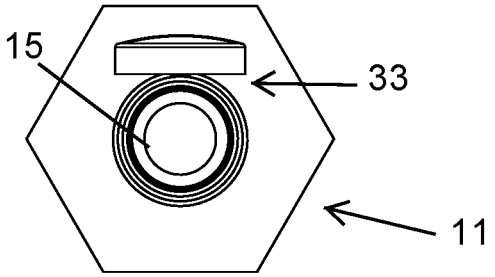
FIG. 9 is a top plan view of the trash receptacle shown in FIG. 8.
Figure 8:
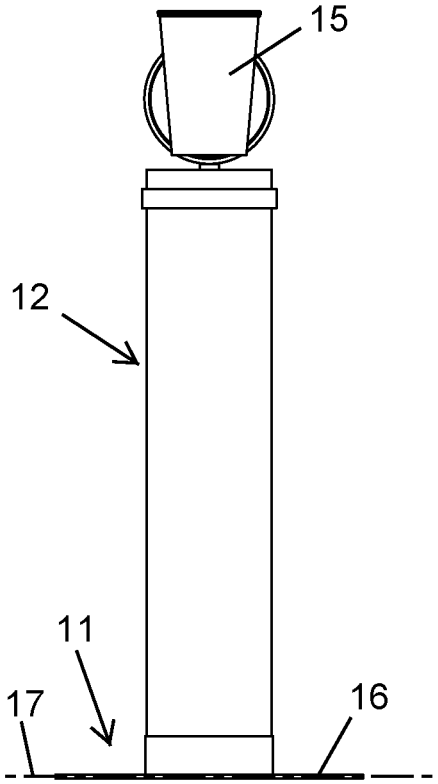
FIG. 8 is a reduced front elevational view of the trash receptacle shown in FIG. 2.
Figure 10:
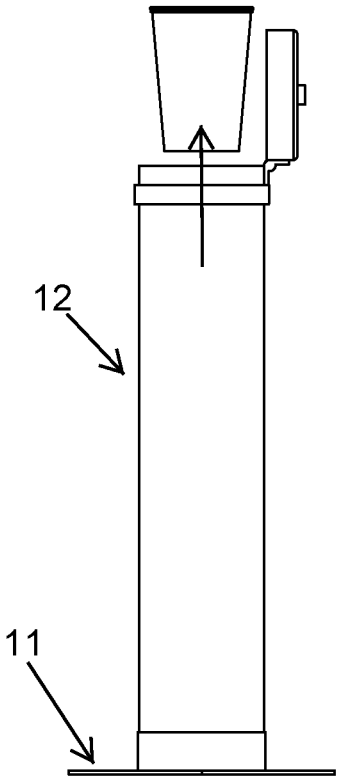
FIG. 10 is a side elevational view of the trash receptacle shown in FIG. 8.
Figure 11:
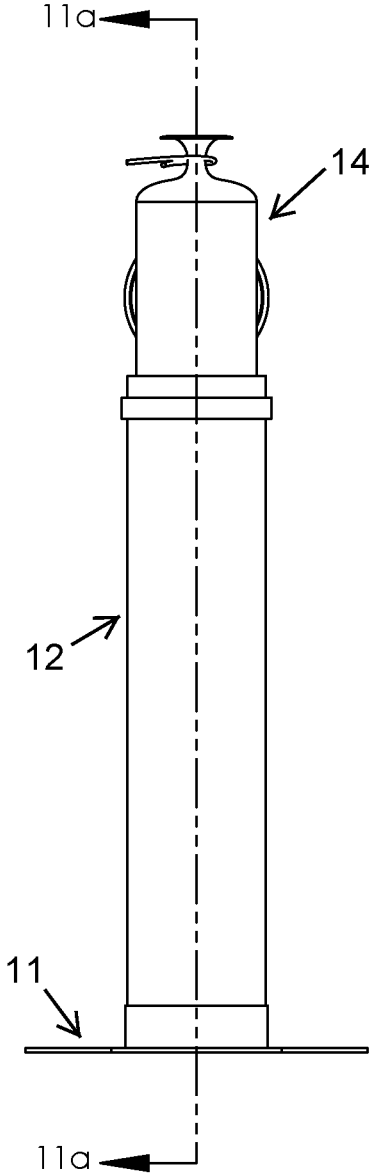
FIG. 11 is a reduced front elevational view of the trash receptacle shown in FIG. 3.
Figure 11A:
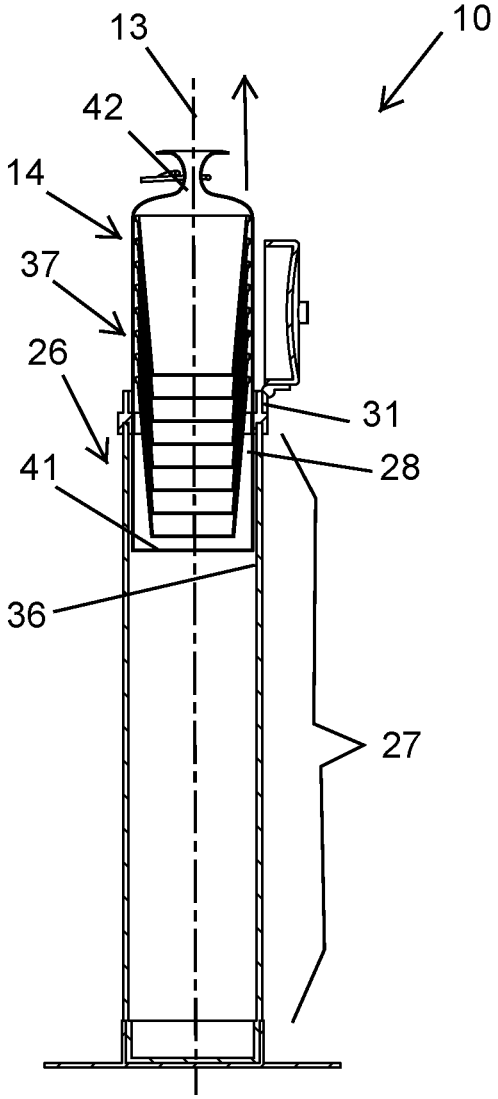
FIG. 11*a* is a cross-sectional view taken along line 11*a*-11*a* shown in FIG. 11.

Non-limiting exemplary embodiment(s) of the present disclosure are referred to generally in FIGS. 1-11*a* and are intended to provide a trash receptacle 10 for recyclable products including a bag-lined recycling receptacle configured for disposing plastic drinking cups 15 in a vertical, nesting or stacked manner 37 and thereby providing environmentally-conscious consumers with a streamlined, space-saving, everyday use receptacle that facilitates easy recycling of commonly used plastic cups 15. The trash receptacle 10 may be a free-standing unit or it can also be easily mounted to a wall. It should be understood that the exemplary embodiment(s) may be used to recycle a variety of cups, and should not be limited to any particular cup described herein.

The non-limiting exemplary embodiment(s) is/are referred to generally in FIGS. 1-11*a* and is/are intended to provide a trash receptacle 10 including a support base 11, and a portable storage container 12 having a centrally registered longitudinal axis 13, wherein the portable storage container 12 is detachably seated on the support base 11 such that the support base 11 is located exterior of the portable storage container 12. A trash bag 14 is removably lined within the storage container 12 and situated about the centrally registered longitudinal axis 13. Advantageously, the trash bag 14 is suitably configured inside the portable storage container 12 to receive and hold existing drink cups 15 in a vertically stacked pattern 37.

In a non-limiting exemplary embodiment, the support base 11 includes a bottom plate 16 situated along a horizontal axis 17 and having a planar top surface 18. An annular neck 19 is centrally positioned on top of the planar top surface 18 such that the annular neck 19 extends upwardly therefrom. Notably, the annular neck 19 has a circumferential outer edge 20 detachably engaged about a bottom portion 21 of the portable storage container 12.

In a non-limiting exemplary embodiment, the support base 11 further includes a wall plate 22 situated along a vertical axis 23 that is parallel to the centrally registered longitudinal axis 13. In this manner, the wall plate 22 is fixedly coupled to the bottom portion 21 and configured to be affixed to an existing vertical support surface 25.

In a non-limiting exemplary embodiment, the portable storage container 12 includes a cylindrical tube 26 extending along a major longitudinal length 27 of the centrally registered longitudinal axis 13. Such a cylindrical tube 26 has an open proximal end 28 and an open distal end 29 axially opposed therefrom. Advantageously, the bottom portion 21 has a stepped-in shoulder 30 located at the open distal end 29 and extended along an entire circumference thereof, wherein the stepped-in shoulder 30 is integrally formed with the cylindrical tube 26.

In a non-limiting exemplary embodiment, the portable storage container 12 further includes a hollow top lip 31 directly mated to the open proximal end 28 and detachably seated exterior of the cylindrical tube 26. Such a hollow top lip 31 is axially opposed from the stepped-in shoulder 30 and concentrically spaced about the centrally registered longitudinal axis 13. A lid 32 is pivotally coupled to an outer peripheral edge of the hollow top lip 31. Such a lid 32 is selectively articulated between an open position 33 and a closed position 34 relative to the open proximal end 28.

In a non-limiting exemplary embodiment, the portable storage container 12 further includes a smooth and continuous interior surface 36 extended along a major longitudinal length 27 of the cylindrical tube 26.

In a non-limiting exemplary embodiment, the trash bag 14 includes a closed bottom end 41 removably situated inside the cylindrical tube 26, and an open top end 42 penetrated upwardly through the hollow top lip 31 and situated exterior of the open proximal end 28. The trash bag 14 is configured to directly abut against the smooth and continuous interior surface 36 of the cylindrical tube 26 such that the existing drink cups 15 are permitted to travel along the centrally registered longitudinal axis 13 and thereby rest in the vertically stacked pattern 37.

The present disclosure further includes a method of utilizing a trash receptacle 10 for collecting and disposing drink cups 15. Such a method including the steps of: providing a support base 11; providing a portable storage container 12 having a centrally registered longitudinal axis 13; detachably seating the portable storage container 12 on the support base 11 such that the support base 11 is located exterior of the portable storage container 12; providing and removably lining a trash bag 14 within the storage container 12 and about the centrally registered longitudinal axis 13; and configuring the trash bag 14 inside the portable storage container 12 to receive and hold existing drink cups 15 in a vertically stacked pattern 37.

Referring to FIGS. 1-11*a* in general, in non-limiting exemplary embodiment(s), the cup-recycling trash receptacle 10 is specially configured for disposing plastic drink cups 15 in a vertical, nesting manner. Boasting a sleek, modern design, the tubular cup-recycling trash receptacle 10 contains a durable stainless-steel exterior, and is sized appropriately to house a large number of cups 15. Plastic liners (trash bag 14) are sized specifically for the narrow channel of the unit. Such liners 14 utilize less plastic than common bin liners, leading to money savings as well as a reduction in waste. The practical size of the cup-recycling trash receptacle 10 allows the receptacle to be unobtrusively stored anywhere, whether in a kitchen, recreation room, garage, or bathroom. Thus, this relatively simple yet extremely effective product is quite easy to use.

After placing receptacle 10 in a desired location, the user lines the receptacle 10 with a companion collection bag 14, securing the top around the lip of the unit and capping it with a provided lid 32. When disposing of a plastic drinking cup 15, the user opens the cup-recycling trash receptacle 10, and drops the cup, right side up, into the receptacle. As each successive empty is tossed in, the cups 15 nest inside each other on their way to the top of the receptacle 10. When the receptacle 10 is filled, the user need only lift the entire bag 14 from the unit, tie it closed, and place the bagged cups 15 in a recycling bin for further disposal.

There are several significant benefits and advantages associated with this unique product. Foremost, the cup-recycling trash receptacle 10 provides an essential recycling implement in one clever and creative unit that reduces the clutter of empty cups left on surfaces, ensuring that the enjoyment of beverages does not result in an unattractive mess. Container 12 is specifically designed to compactly house empty plastic everyday drink cups 15. This slim-line unit eliminates the need to purchase multiple containers for collection needs. Offering an aesthetically pleasing, stainless steel appearance, the cup-recycling trash receptacle 10 looks striking in today's modern homes.

As an option, a crushing mechanism may be employed to further compact the cups 15 inside bag 14.

In addition, the nesting of cups 15 significantly increases the amount of space available in recycling bins, allowing consumers to discard many more empties before a trip to the recycling center is necessary. Children will especially delight in dropping cups into this unit, watching as each empty cup 15 slides directly into a waiting one below. In this manner, the cup-recycling trash receptacle 10 instills in youth the importance of recycling in a fun and interesting way. Ideal for families and individuals who consume copious amounts of beverages, this clever product proves especially beneficial when hosting parties and get-togethers with family and friends. Made of durable, high quality materials, the cup-recycling trash receptacle 10 will withstand years of continued use.

The cup-recycling trash receptacle 10 is an innovative product that provides an extremely useful accessory for recycling and trash collecting efforts. Simple in design yet effective in application, this product proves an invaluable addition to any kitchen, garage, or outdoor patio.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A trash receptacle for collecting and disposing drink cups, said trash receptacle comprising:

a support base;

a portable storage container detachably seated on said support base, said portable storage container having a centrally registered longitudinal axis; and a trash bag removably lined within said storage container and about the centrally registered longitudinal axis;

wherein said trash bag is configured inside said portable storage container to receive and hold existing drink cups in a vertically stacked pattern;

wherein said support base comprises:

a bottom plate situated along a horizontal axis and having an entirely planar top surface, said entirely planar top surface being uninterrupted and extended along an entire surface area of said bottom plate; and an annular neck centrally positioned on top of said planar top surface such that said annular neck extends upwardly therefrom;

wherein said annular neck has a circumferential outer edge detachably engaged about a bottom portion of said portable storage container, said circumferential outer edge being continuous, uninterrupted and extended along an entire circumference of said annular neck;

wherein said portable storage container comprises:

a cylindrical tube extending along a major longitudinal length of the centrally registered longitudinal axis, said cylindrical tube having an open proximal end and an open distal end axially opposed therefrom;

wherein said bottom portion has a stepped-in shoulder located at said open distal end and extended along an entire circumference thereof, wherein said stepped-in shoulder is integrally formed with said cylindrical tube, said stepped-in shoulder being extended downwardly to a bottom-most open edge of said open distal end.

2. The trash receptacle of claim 1, wherein said support base further comprises:

a wall plate situated along a vertical axis parallel to the centrally registered longitudinal axis, wherein said wall plate is fixedly coupled to said bottom portion and configured to be affixed to an existing vertical support surface.

3. The trash receptacle of claim 2, wherein said portable storage container further comprises:

a hollow top lip directly mated to said open proximal end and detachably seated exterior of said cylindrical tube, said hollow top lip being axially opposed from said stepped-in shoulder and spaced about the centrally registered longitudinal axis; and a lid pivotally coupled to an outer peripheral edge of said hollow top lip, said lid being selectively articulated between an open position and a closed position relative to said open proximal end.

4. The trash receptacle of claim 3, wherein said portable storage container further comprises:

a smooth and continuous interior surface extended along a major longitudinal length of said cylindrical tube.

5. The trash receptacle of claim 4, wherein said trash bag comprises:

a closed bottom end removably situated inside said cylindrical tube; and an open top end penetrated upwardly through said hollow top lip and situated exterior of said open proximal end;

wherein said trash bag is configured to directly abut against said smooth and continuous interior surface of said cylindrical tube such that the existing drink cups are permitted to travel along the centrally registered longitudinal axis and thereby rest in the vertically stacked pattern.

6. A trash receptacle for collecting and disposing drink cups, said trash receptacle comprising:

a support base;

a portable storage container detachably seated on said support base, said portable storage container having a centrally registered longitudinal axis; and a trash bag removably lined within said storage container and about the centrally registered longitudinal axis;

wherein said trash bag is configured inside said portable storage container to receive and hold existing drink cups in a vertically stacked pattern;

wherein said support base is located exterior of said portable storage container;

wherein said support base comprises:

a bottom plate situated along a horizontal axis and having an entirely planar top surface, said entirely planar top surface being uninterrupted and extended along an entire surface area of said bottom plate; and an annular neck centrally positioned on top of said planar top surface such that said annular neck extends upwardly therefrom;

wherein said annular neck has a circumferential outer edge detachably engaged about a bottom portion of said portable storage container, said circumferential outer edge being continuous, uninterrupted and extended along an entire circumference of said annular neck;

wherein said portable storage container comprises:

a cylindrical tube extending along a major longitudinal length of the centrally registered longitudinal axis, said cylindrical tube having an open proximal end and an open distal end axially opposed therefrom;

wherein said bottom portion has a stepped-in shoulder located at said open distal end and extended along an entire circumference thereof, wherein said stepped-in shoulder is integrally formed with said cylindrical tube, said stepped-in shoulder being extended downwardly to a bottom-most open edge of said open distal end.

7. The trash receptacle of claim 6, wherein said support base further comprises:

a wall plate situated along a vertical axis parallel to the centrally registered longitudinal axis, wherein said wall plate is fixedly coupled to said bottom plate and configured to be affixed to an existing vertical support surface.

8. The trash receptacle of claim 7, wherein said portable storage container further comprises:

a hollow top lip directly mated to said open proximal end and detachably seated exterior of said cylindrical tube, said hollow top lip being axially opposed from said stepped-in shoulder and spaced about the centrally registered longitudinal axis; and a lid pivotally coupled to an outer peripheral edge of said hollow top lip, said lid being selectively articulated between an open position and a closed position relative to said open proximal end.

9. The trash receptacle of claim 8, wherein said portable storage container further comprises:

a smooth and continuous interior surface extended along a major longitudinal length of said cylindrical tube.

10. The trash receptacle of claim 9, wherein said trash bag comprises:

a closed bottom end removably situated inside said cylindrical tube; and an open top end penetrated upwardly through said hollow top lip and situated exterior of said open proximal end;

wherein said trash bag is configured to directly abut against said smooth and continuous interior surface of said cylindrical tube such that the existing drink cups are permitted to travel along the centrally registered longitudinal axis and thereby rest in the vertically stacked pattern.

11. A method of utilizing a trash receptacle for collecting and disposing drink cups, said method comprising the steps of:

providing a support base;

providing a portable storage container having a centrally registered longitudinal axis;

detachably seating said portable storage container on said support base such that said support base is located exterior of said portable storage container;

providing and removably lining a trash bag within said storage container and about the centrally registered longitudinal axis; and configuring said trash bag inside said portable storage container to receive and hold existing drink cups in a vertically stacked pattern;

wherein said support base comprises:

a bottom plate situated along a horizontal axis and having an entirely planar top surface, said entirely planar top surface being uninterrupted and extended along an entire surface area of said bottom plate; and an annular neck centrally positioned on top of said planar top surface such that said annular neck extends upwardly therefrom;

wherein said annular neck has a circumferential outer edge detachably engaged about a bottom portion of said portable storage container, said circumferential outer edge being continuous, uninterrupted and extended along an entire circumference of said annular neck;

wherein said portable storage container comprises:

a cylindrical tube extending along a major longitudinal length of the centrally registered longitudinal axis, said cylindrical tube having an open proximal end and an open distal end axially opposed therefrom;

wherein said bottom portion has a stepped-in shoulder located at said open distal end and extended along an entire circumference thereof, wherein said stepped-in shoulder is integrally formed with said cylindrical tube, said stepped-in shoulder being extended downwardly to a bottom-most open edge of said open distal end.

* * * * *